US006225757B1

(12) United States Patent
Brosius, IV et al.

(10) Patent No.: US 6,225,757 B1
(45) Date of Patent: May 1, 2001

(54) COMBINATION MH/HPS BALLAST

(75) Inventors: William L. Brosius, IV, Brentwood, TN (US); Robert P. Boydston, Madison, AL (US); Daniel Soule, Harlingen, TX (US); Candler A. Willis, Zirconia, NC (US)

(73) Assignee: MagneTek Corp., Huntsville, AL (US)

( * ) Notice: Subject to any disclaimer, the term of this patent is extended or adjusted under 35 U.S.C. 154(b) by 0 days.

(21) Appl. No.: 09/574,902

(22) Filed: May 19, 2000

(51) Int. Cl.[7] ..... H05B 37/00

(52) U.S. Cl. ..... 315/250; 315/240; 315/254; 315/276

(58) Field of Search ..... 315/276, 283, 315/284, 194, 199, 227 R, 240, 242, 250, 254

(56) References Cited

U.S. PATENT DOCUMENTS 3,599,037 8/1971 Grace .
3,772,565 11/1973 Lenz et al. .
3,873,910 3/1975 Willis, Jr. .
4,016,452 4/1977 Willis .
4,162,428 7/1979 Elms .
4,350,934 9/1982 Spreadbury .
4,501,994 2/1985 Spreadbury .

*Primary Examiner*—David Vu
(74) *Attorney, Agent, or Firm*—Waddey & Patterson; Larry W. Brantley

(57) ABSTRACT

A combination electronic ballast designed to operate a metal halide lamp and a high-pressure sodium gas discharge lamp is disclosed. The ballast includes a primary and secondary coil coupled to a magnetic core. The primary is adapted to be connected to an ac power source and the secondary is adapted to be connected to a metal halide lamp and a high-pressure sodium lamp. The primary and secondary coils are connected together using a capacitance circuit including two capacitors and a switch. The capacitance circuit is designed to connect both of the capacitors between the primary and secondary coil when a high pressure sodium lamp is connected to the ballast and to connect only one of the capacitors in parallel when a metal halide lamp is connected to the ballast. In an alternative embodiment, the primary is adapted to be connected to one of four different ac power sources.

15 Claims, 1 Drawing Sheet

COMBINATION MH/HPS BALLAST

BACKGROUND OF THE INVENTION

The present invention relates generally to a ballast for gas discharge lamps. More particularly, this invention pertains to a ballast that may be used with both Metal Halide (MH) Lamps and High Pressure Sodium (HPS) Lamps.

Ballast devices for gas discharge lamps are well known in the art. For example, U.S. Pat. Nos. 3,599,037, 3,772,565, 3,873,910, 4,016,452, 4,162,428, 4,350,934, 4,501,994 disclose ballast devices that may be used to control various types of gas discharge lamps. None of these patents, however, disclose or suggest a ballast that may be used to control both a MH lamp and a HPS lamp.

Generally, a ballast designed to control a MH lamp (a MH ballast) may not be used to control an HPS lamp. An HPS lamp requires a starting aid, a low starting voltage, and a large current to operate properly. A MH ballast, on the other hand, does not include a starting aid and cannot be used to control an HPS lamp because an MH ballast provides a voltage that is higher than that required for the HPS lamp, as well as, a current that is lower than that required for the HPS lamp.

In addition, the voltage drop across an HPS lamp exhibits a wide range over the lifetime of the lamp. Thus, an HPS ballast is also designed to vary the current delivered to an HPS lamp in response to the voltage drop of the HPS lamp. As a result, the power delivered to the HPS lamp remains within a desired range over the entire range of voltages exhibited by the HPS lamp. A MH ballast does not provide the required variation in current. Furthermore, even if a starting aid is incorporated into a MH ballast, the HPS lamp will operate grossly under-wattage and exhibit wide variations in operating wattage as the HPS lamp exhibits its customary swings in voltage.

For similar reasons, an HPS ballast may not be used to control a MH lamp. If a standard MH lamp is used with an HPS ballast, the MH lamp will operate in an over-wattage state.

As a result of the incompatibility between HPS ballasts and MH ballasts, end users of MH and HPS lamps are required to purchase both types of ballasts, that is MH ballasts and HPS ballasts. The costs associated with purchasing both types of ballasts are undesirably high and end users have indicated a desire for a single ballast capable of operating both a MH lamp and an HPS lamp.

What is needed, then, is a combination ballast that may be used to operate both MH and HPS lamps.

SUMMARY OF THE INVENTION

Accordingly, an object of the present invention is to provide a combination ballast for operating both MH lamps and HPS lamps.

Another object is to provide a combination ballast capable of delivering a current to a HPS lamp that is dependent on the voltage drop across the HPS lamp.

A further object of the present invention is to provide a combination ballast having a capacitance circuit with a capacitance and a means for varying the capacitance of the capacitance circuit.

These and other objects are provided by a ballast including a magnetic core, a primary coil wrapped around the magnetic core, a secondary coil wrapped around the magnetic core, a capacitance circuit having a capacitance connected between the primary coil and the secondary coil, a switch included in the capacitance circuit for varying the capacitance of the capacitance circuit, and a starting aid for lamp starting.

DESCRIPTION OF THE PREFERRED EMBODIMENTS

Figure 1:
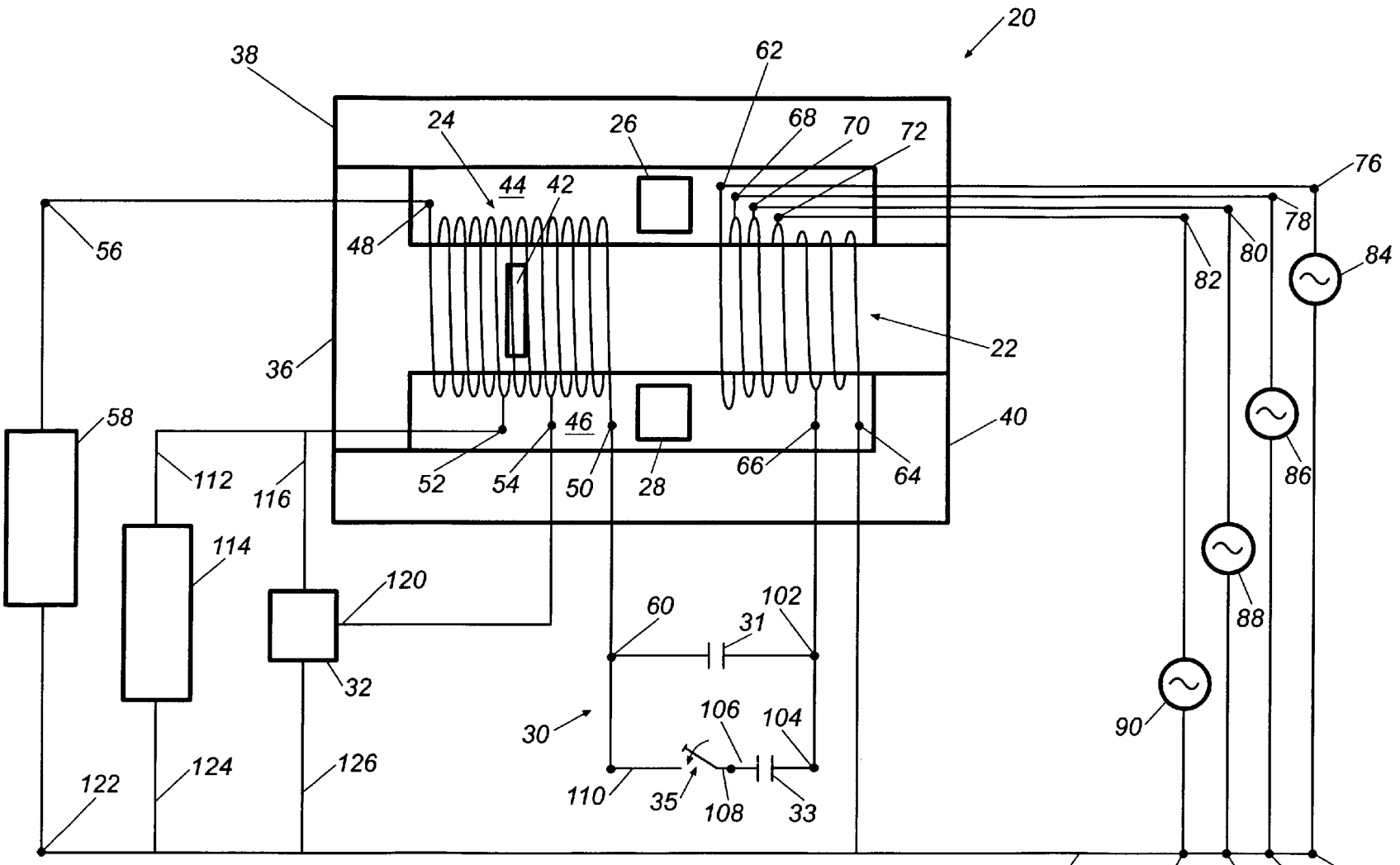
FIG. 1 is a block diagram of one embodiment of the present invention.

Referring to FIG. 1, one embodiment of the present invention includes a magnetic core 20, a primary coil 22, a secondary coil 24, a pair of shunts, 26 and 28, a capacitance circuit 30, and a starting aid 32. Magnetic core 20 is commonly referred to as a T-L magnetic core; that is, a magnetic core formed out of a T-shaped magnetic portion 36 and two L-shaped portions, 38 and 40. Magnetic core 20 is designed to provide a magnetic circuit for the ballast as is well known in the art and may vary in size according to the wattage of lamps that are connected to the ballast. In one embodiment, designed to operate a 400 watt HPS lamp and a 400 watt MH lamp, the magnetic core 20 is 5.75 inches long, 4.250 inches wide, and 2.32 inches high.

T-shaped portion 36 includes a slot 42 positioned at one end of T-shaped portion 36 for controlling the secondary magnetizing reactance of the ballast. The present invention contemplates that the size of slot 42 may be varied as necessary in order to optimize the operation of the ballast. In one embodiment, slot 42 has a width of 0.156 inches and a length of 1.125 inches.

Magnetic core 20 also includes first and second windows, 44 and 46, separated by T-shaped portion 36. Although a T-L magnetic core is described above, other types of magnetic cores known in the art, such as an E-I magnetic core, may be used as well.

Secondary coil 24 is wrapped around the T-shaped magnetic portion 36 over slot 42 and includes a MH lamp connector tap 48, a secondary capacitance circuit tap 50, a HPS lamp connector tap 52, and a starting aid tap 54. The MH lamp connector tap 48 is adapted to be connected to one end 56 of a MH lamp 58, the capacitance circuit tap 50 is connected to the capacitance circuit 30, the HPS lamp connector tap 52 is connected to one input 116 of starting aid 32 and designed to be connected to one end 112 of an HPS lamp 114, and starting aid connector 54 is connected to a second input 120 of the starting aid 32.

MH lamp connector tap 48 and HPS lamp connector tap 52 should be positioned on secondary coil 24 so that the voltage necessary for operating the MH lamp appears at the MH lamp connector tap 48 and the voltage necessary for operating the HPS lamp appears at HPS lamp connector tap 52. This is accomplished by positioning MH lamp connector tap 48 and HPS lamp connector tap 52 on secondary coil 24 so that a sufficient number of turns are included between the MH lamp connector tap 48 and the capacitance circuit tap 50 and the HPS lamp connector 52 and capacitance circuit tap 50. In a similar manner, starting aid tap 54 should be positioned on secondary coil 24 so that the voltage necessary for operating the starting aid 32 appears at the starting aid tap 54. Thus, starting aid connector tap 54 should be positioned on secondary coil 24 so that a sufficient number of turns are included between starting aid connector tap 54 and capacitance circuit tap 50.

For example, in one embodiment designed to operate a 400 watt MH lamp and a 400 watt HPS lamp, secondary coil 24 includes 458 turns of Number 15½ Copper wire between MH lamp connector tap 48 and capacitance circuit tap 50, HPS lamp connector tap 52 is positioned at 297 turns, and starting aid tap 54 is positioned at 268 turns. In an alternative embodiment, Number 15 Copper wire may be used for the secondary coil 24 in order to reduce thermal heating in the secondary coil.

Second end 122 of MH lamp 56, second end 124 of HPS lamp 114, and third input 126 of starting aid 32 are designed to be connected to a common terminal 100. Although FIG. 1 shows both MH lamp 58 and HPS lamp 114 connected to the ballast, the present invention contemplates that only one of the lamps will be connected at any given time. Thus, either MH lamp 58 or HPS lamp 114 may be connected to the present invention at any given time.

Primary coil 22 is wrapped around T-shaped portion 36 and separated from secondary coil 24 by magnetic shunts, 26 and 28. The embodiment shown in FIG. 1 is a multi-volt embodiment of the present invention. As such, primary coil 22 includes first, second, third, and fourth ac power source connector taps 62, 68, 70, 72, a common terminal tap 64, and a primary capacitance circuit tap 66. In an alternative embodiment where the ballast will not be required to operate with multiple ac power sources, the primary coil may include only one ac power source connector tap for connection to an ac power source.

First, second, third, and fourth ac power source connector taps 62, 68, 70, and 72 are designed to be connected to positive terminals 76, 78, 80, and 82 of ac power sources 84, 86, 88, and 90. In one embodiment, ac power sources 84, 86, 88, and 90 are 277, 240, 208, and 120 volt ac power sources, respectively. Although FIG. 1 shows all four ac power sources connected to the ballast, the present invention contemplates having only one ac power source connected at a time. Thus, only ac power source 84, 86, 88, or 90 would be connected at any given time. Alternative embodiments may include different ac power source voltages.

Returning to FIG. 1, first, second, third, and fourth ac power source connector taps 62, 68, 70, and 72 should be positioned on primary coil 22 so that the voltage necessary for operating the MH lamp 58 appears at the MH lamp connector tap 48, the voltage necessary for operating the HPS lamp 114 appears at the HPS lamp connector tap 52, and the voltage necessary for operating the starting aid 32 appears at the starting aid tap 54. The necessary voltages may be produced by including a sufficient number of turns between each ac power source connector tap and the common terminal tap 64.

For example, in one embodiment designed to operate a 400 watt MH lamp and a 400 watt HPS lamp, primary coil 22 includes 339 turns of Number 19 Copper wire between first ac power source connector tap 62 and common terminal tap 64, second ac power source connector tap 68 is positioned at 294 turns, third ac power source connector tap 70 is positioned at 252 turns, and fourth ac power source connector tap 72 is positioned at 147 turns. Common terminal tap 64, as well as negative terminals 92, 94, 96, and 98, are designed to be connected to terminal 100.

Capacitance circuit 30 includes a first capacitor 31 having a first end 60 and a second end 102, a second capacitor 33 having a first end 104 and a second end 106, and a switch 35 having a first end 108 and a second end 110. Secondary capacitance circuit tap 50 is connected to first end 60 of first capacitor 31 and second end 110 of switch 35. Primary capacitance circuit tap 66 is connected to second end 102 of first capacitor 31 and first end 104 of second capacitor 33. Finally, second end 106 of second capacitor 33 is connected to first end 108 of switch 35.

Capacitance circuit 30 is designed to vary the capacitive reactance of the ballast. As is known in the art, a MH lamp requires a ballast having a leakage reactance of approximately 0.75 to 1.0 times the value of the capacitive reactance of the ballast. Another way of stating this relationship is that the capacitive reactance is 1.0 to 1.33 times the value of the leakage reactance. HPS ballasts, on the other hand require a leakage reactance in the range of 2 to 4 times that of the capacitive reactance of the ballast. Or alternatively, the capacitive reactance should be 0.25 to 0.5 times the leakage reactance. The switch 35 varies the capacitive reactance by placing the second capacitor 33 in parallel with the first capacitor 31. By proper selection of the first and second capacitors, the capacitance reactance of the ballast may be varied from 0.25 to 0.5 times the value of the leakage reactance to 1.0 to 1.33 times the value of the leakage reactance.

For example, in one embodiment, designed to operate a 400 watt HPS lamp and a 400 watt MH lamp, first capacitor 31 is a 29 $\mu$F capacitor and second capacitor 33 is a 26 $\mu$F capacitor. When a MH lamp is connected to the present invention, switch 34 is open and only first capacitor 31 is connected between the primary and secondary windings. When an HPS lamp is connected, switch 35 is closed and both first capacitor 31 and second capacitor 33 are connected between the primary and secondary windings. Thus, the capacitance of the capacitance circuit 30 may be varied by opening and closing switch 35. Those skilled in the art will recognize that first capacitor 31 and second capacitor 35 may be varied to optimize the operation of the ballast.

Magnetic shunts, 26 and 28, are designed to control the leakage reactance between the primary and secondary coils, 22 and 24, as is well known in the art. The size of the magnetic shunts should be selected so that the ballast has the desired leakage reactance for a given capacitive reactance. Since the value of the leakage reactance and capacitive reactance are proportionally related the desired leakage reactance will depend on the value of the capacitive reactance of the ballast and, accordingly, the capacitive reactance will depend on the value chosen for the leakage reactance. In one embodiment, magnetic shunts, 26 and 28, are both 2.5 inches long, 0.75 inches high, and 0.670 inches wide. When positioned within windows, 44 and 46, an air gap of 0.024 inches remains around each shunt.

Thus, although there have been described particular embodiments of the present invention of a new and useful Combination MH/HPS Ballast, it is not intended that such references be construed as limitations upon the scope of this invention except as set forth in the following claims.

The invention claimed is:

1. A combination ballast for powering either of first and second types of gas discharge lamps when connected to an ac power source comprising:

a magnetic core;

a primary coil wound on the magnetic core and coupled to a first end of a portion of the magnetic core, the primary coil adapted to be connected to the ac power source;

a secondary coil coupled to a second end of the portion of the magnetic core, the secondary coil connected to a starting aid and to either the first or second types of gas discharge lamps, the starting aid adapted to start both types of gas discharge lamps;

a capacitance circuit having a capacitance electrically connected between the primary coil and the secondary coil; and means for switching the capacitance of the capacitance circuit between a first predetermined value for operating the first type of gas discharge lamp and a second predetermined value for operating the second type of gas discharge lamp.

2. The ballast of claim 1, wherein the first type of gas discharge lamp comprises a high-pressure sodium lamp and the second type of gas discharge lamp comprises a metal halide lamp.

3. The ballast of claim 2, wherein the starting aid is adapted to pulse start the metal halide lamp.

4. The ballast of claim 1, wherein the second end of the portion of the magnetic core includes a slot.

5. The ballast of claim 1, wherein the primary coil is adapted to be connected to one of four different ac power sources.

6. The ballast of claim 1, wherein the secondary coil includes more turns than the primary coil.

7. The ballast of claim 1, wherein the secondary coil wire diameter is larger than the primary coil wire diameter.

8. The ballast of claim 1, wherein the capacitance circuit includes:

first and second capacitors connected in parallel between the primary and secondary coils.

9. The ballast of claim 8, wherein the means for switching the capacitance of the capacitance circuit includes:

a switch connected to the first and second capacitors such that the second capacitor is connected in parallel with the first capacitor when the switch is in a first position and the second capacitor is disconnected from the first capacitor when the switch is in a second position.

10. A lamp ballast for operating two different types of gas discharge lamps, comprising:

a magnetic core having a first window and a second window separated by a portion of the magnetic core, the portion having a first end and a second end;

a first magnetic shunt positioned within the first window;

a second magnetic shunt positioned within the second window;

a slot located on the first end of the portion of the magnetic core;

a primary coil coupled to the second end of the portion of the magnetic core and having a first ac power connector and a common terminal tap adapted to be connected to a first ac power source, the primary coil including a primary tap connector;

a secondary coil coupled to the first end of the portion of the magnetic core and positioned over the slot, the secondary coil having a first end, a second end, a lamp tap connector, and a starting aid tap connector, the first end adapted to be connected with a first type of gas discharge lamp, the lamp tap connector connected to a starting aid and adapted to be connected with a second type of gas discharge lamp, and the starting aid tap connector connected to the starting aid, the starting aid adapted to start both types of gas discharge lamps;

a first capacitor having a first end connected to the primary coil using the primary tap connector and a second end connected to the secondary coil using the second end of the secondary coil;

a second capacitor having a first end connected to the first end of the first capacitor; and a switch connected to the second end of the first capacitor and to a second end of the second capacitor.

11. The ballast of claim 10, wherein the first type of gas discharge lamp comprises a high-pressure sodium lamp and the second type of gas discharge lamp comprises a metal halide lamp.

12. The ballast of claim 11, wherein the starting aid is adapted to pulse start the metal halide lamp.

13. The ballast of claim 10, wherein:

the primary coil further includes second, third, and fourth ac power connectors, the second ac power connector is adapted to be connected to a second ac power source, the second ac power source having a voltage smaller than the first ac power source, the third ac power connector is adapted to be connected to a third ac power source, the third ac power source having a voltage smaller than the second ac power source, the fourth ac power connector is adapted to be connected to a fourth ac power source, and the fourth ac power source having a voltage smaller than the third ac power source.

14. The ballast of claim 10, wherein the secondary coil includes a greater number of turns than the primary coil.

15. The ballast of claim 10, wherein the secondary coil wire diameter is larger than the primary coil wire diameter.

* * * * *